US007607626B2

(12) United States Patent
Whitmire

(10) Patent No.: US 7,607,626 B2
(45) Date of Patent: Oct. 27, 2009

(54) ARROW HOLDER

(76) Inventor: Fred M. Whitmire, P.O. Box 407, Penrose, NC (US) 28766

( * ) Notice: Subject to any disclaimer, the term of this patent is extended or adjusted under 35 U.S.C. 154(b) by 290 days.

(21) Appl. No.: 11/455,555

(22) Filed: Jun. 19, 2006

(65) Prior Publication Data

US 2007/0004520 A1 Jan. 4, 2007

Related U.S. Application Data

(60) Provisional application No. 60/695,923, filed on Jul. 2, 2005.

(51) Int. Cl.
*A47F 5/00* (2006.01)

(52) U.S. Cl. ..... 248/309.1; 182/92

(58) Field of Classification Search ..... 248/309.1, 248/217.4, 218.4, 222.13, 500, 677, 76, 201; 124/88, 25.5, 25.7, 916; 182/92
See application file for complete search history.

(56) References Cited

U.S. PATENT DOCUMENTS

| | | | | |
|---|---|---|---|---|
| 1,463,554 | A * | 7/1923 | PIERMAN ALEXANDER N | 248/176.1 |
| 2,023,517 | A * | 12/1935 | Creager et al. | 338/319 |
| 2,855,107 | A * | 10/1958 | ADOLPH ROTH | 211/70.6 |
| 5,050,252 | A * | 9/1991 | Cuttriss | 4/576.1 |
| 5,114,107 | A | 5/1992 | Mahn et al. | |
| 5,190,022 | A * | 3/1993 | Larson | 124/25.7 |
| 5,437,377 | A | 8/1995 | Riemenschneider | |
| 5,775,313 | A * | 7/1998 | Bresette et al. | 124/86 |
| 5,941,484 | A | 8/1999 | Stepney, III et al. | |
| 5,967,475 | A * | 10/1999 | Johnson | 248/217.4 |
| 6,672,299 | B2 | 1/2004 | Proctor | |
| 6,691,694 | B2 * | 2/2004 | Stinson | 124/86 |

* cited by examiner

*Primary Examiner*—Ramon O Ramirez
(74) *Attorney, Agent, or Firm*—James Ray & Assoc.

(57) ABSTRACT

An apparatus for use by a bow hunter using a tree stand to hunt. The apparatus comprises a rod member having a predetermined shape and formed of a first predetermined material. A screw member is engageable intermediate each end of the rod member for attaching the rod member to a tree, and there is at least one holder attached to at least one end of the rod member for holding an arrow. The at least one holder is formed of a second predetermined material.

17 Claims, 2 Drawing Sheets

ARROW HOLDER

CROSS REFERENCE TO RELATED APPLICATIONS

This application is closely related to and claims benefit from U.S. Provisional Application Ser. No. 60/695,923 filed Jul. 2, 2005.

FIELD OF THE INVENTION

The present invention relates, in general, to an aid in bow hunting from a tree stand, and, more particularly, the present invention relates to an apparatus for holding a second arrow in easy access for a bow hunter when a second shot is necessary.

BACKGROUND OF THE INVENTION

Hunting with a bow and arrow has been steadily growing in popularity through the years. Most bow hunters prefer to hunt from a tree stand, where the sit or stand on an elevated perch. These hunters normally have a quiver holding their arrows attached to the bow. Due to the loud rattling noise that can occur when reaching for a second arrow from the quiver, most hunters usually remove the quiver. Hunters also remove the quiver to reduce the weight of the bow. Removing the quiver can also cut down on the vibration of the bow. However, removing the quiver leaves the archer without quick access to another arrow for a second shot.

If the hunter happens to miss on the first shot, he must reach for the quiver to get a second arrow. In addition to making noise, reaching for a second arrow requires a good deal of movement and takes some extra time, particularly if the quiver is not handy. Bow hunting requires quick and quiet movements at all times. Thus, it would be advantageous for the bow hunter if the second arrow could be kept where it would be readily available and relatively easy for the bow hunter to get to and so have an arrow for the critical second or follow up shot.

SUMMARY OF THE INVENTION

In a first aspect the present invention provides an apparatus for use by a bow hunter using a tree stand to hunt. The apparatus comprises a rod member having a predetermined shape and formed of a first predetermined material. A screw member is engageable intermediate each end of the rod member for attaching the rod member to a tree, and there is at least one holder attached to at least one end of the rod member for holding an arrow. The at least one holder being formed of a second predetermined material.

OBJECTS OF THE INVENTION

It is, therefore, one of the primary objects of the present invention to provide a bow hunter when using a tree stand with an apparatus for quick and easy access to a second arrow if the target is not hit on the first shot.

Another object of the present invention is to provide a bow hunter when using a tree stand with an apparatus for holding such second arrow which is outside the quiver.

Still another object of the present invention is to provide a bow hunter when using a tree stand with an apparatus for a safe and quiet way to secure additional arrows.

Yet another object of the present invention is to provide a bow hunter when using a tree stand with an apparatus that is easy to use and secure a second arrow in a handy place.

These and various other objects and advantages of this invention will become apparent after a full reading of the following detailed description, particularly, when read in conjunction with the attached drawings as described below and the appended claims.

Figure 2:
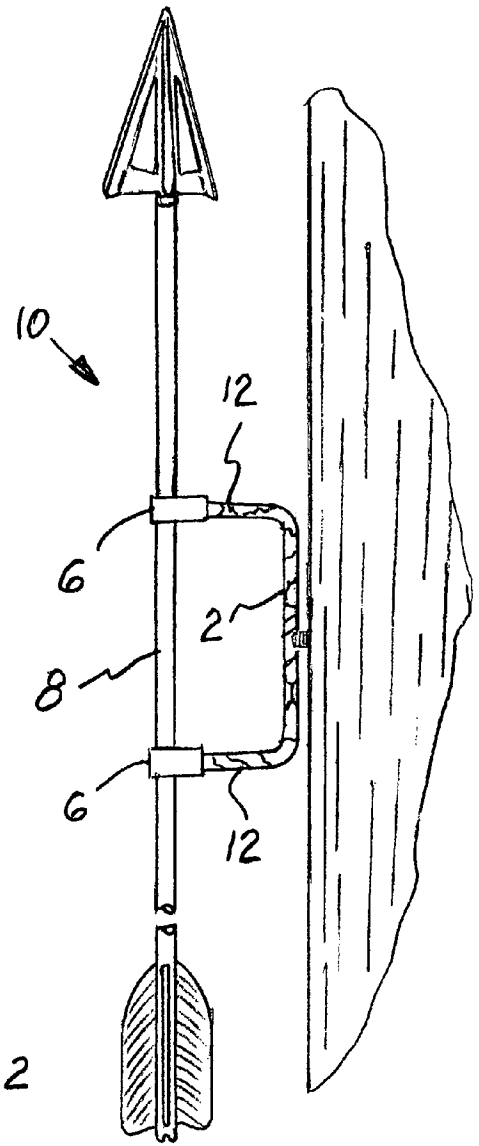
FIG. 2 is a side view of the apparatus shown in FIG. 1 attached to a tree with an arrow disposed therein.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

Figure 1:
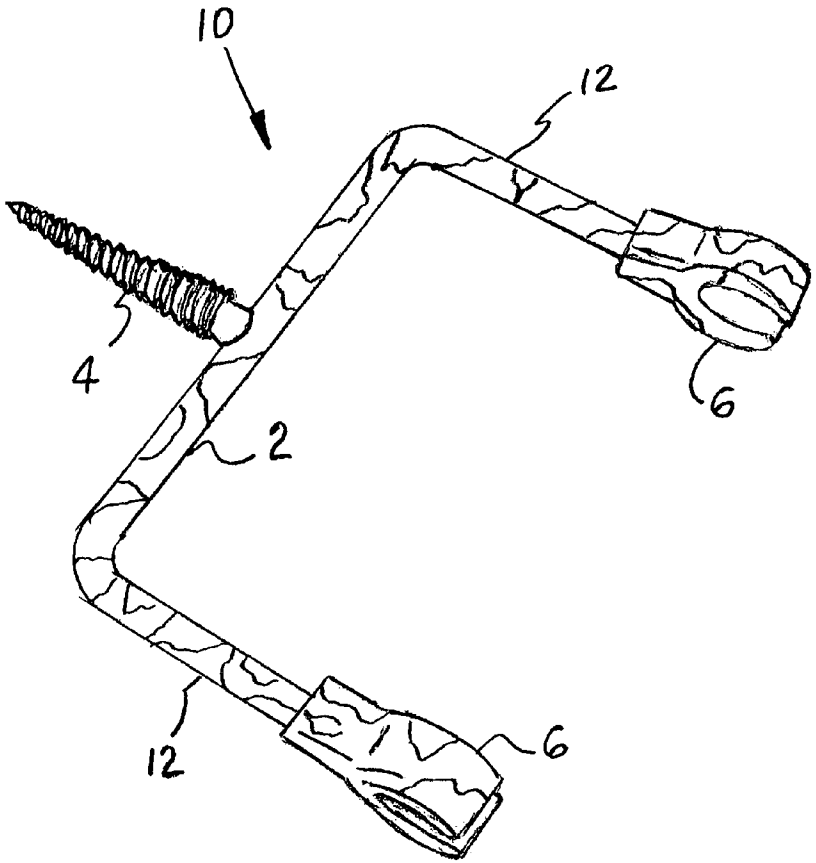
FIG. 1 is a perspective view of the apparatus according to an embodiment showing a preferred shape of the apparatus.

In a first aspect the present invention provides an apparatus, generally designated 10, for use by a bow hunter using a tree stand to hunt. The apparatus 10 comprises a rod member 2 having a predetermined shape and formed of a first predetermined material. A screw member 4 is engageable intermediate each end of the rod member 2 for attaching the rod member 2 to a tree, and there is at least one holder 6 attached to at least one end of the rod member 2 for holding an arrow 8. The at least one holder 6 being formed of a second predetermined material. As is clearly seen in FIG. 1 such rod member 2 has a substantially flat base portion and an arm extending outwardly in a same direction from each end of the base portion.

It is presently preferred that the predetermined shape of the rod member 2 is substantially a block C-shape and that there are a pair of holders 6. Each holder 6 is attached to an end of each arm 12 of said block C shaped rod member 2.

It is also preferred that such rod member 2 and such screw member 4 be made of metal and that such metal is steel. Whereas it is preferred that such holder(s) 6 be formed of an elastomeric material and that the elastomeric material be selected from one of plastic, natural rubber, synthetic rubber and various combinations thereof. It is presently preferred that such material is synthetic rubber.

Since this apparatus 10 is used for hunting and primarily hunting from a tree stand it is preferred that such apparatus be colored in one of a natural coloring and camouflage coloring. This will lessen or eliminate the problem with the sun reflecting off of a shiny metal and thereby alert a deer or whatever prey is being hunted of the presence of man.

The screw member 4 of the block C-shaped rod member 2 is screwed into the tree at a height that is comfortable for the hunter and where the arrow 8 is easily accessible. The apparatus 10 is disposed on such tree so that such arrow 8 when placed in the holder 6 is secured in a vertical plane with point of the arrow 8 pointing upward. The arrow 8 is secured with the point up for security and safety.

Such wood screw member 4 is approximately 2 inches in length and the C-shaped rod member is approximately 2 inches deep so that the entire apparatus 10 from the screw tip to the rubber holder 6 is approximately 4 inches. It is also preferred that such screw member 4 be formed with the C-shaped rod member 2 at substantially a midpoint of the center portion of the rod member 2.

Thus, once the hunter secures such apparatus 10 to a tree the hunter places an arrow 8 into the holder 6 which has an interior diameter of approximately ¼ inch so as to snugly hold the arrow in place. The opening can be flexed and extended to approximately ½ inch so as to accommodate larger arrows if necessary. The holders 6 located at the end of each arm member 12 are approximately 3½ inches apart and can easily secure a single arrow therein. The hunter is now ready with one arrow in the bow and one arrow 8 disposed in the apparatus 10 ready if a second shot is necessary. If a second shot becomes necessary the second arrow is easily accessible and the hunter can quickly, easily and quietly reach for the second arrow.

Figure 3:
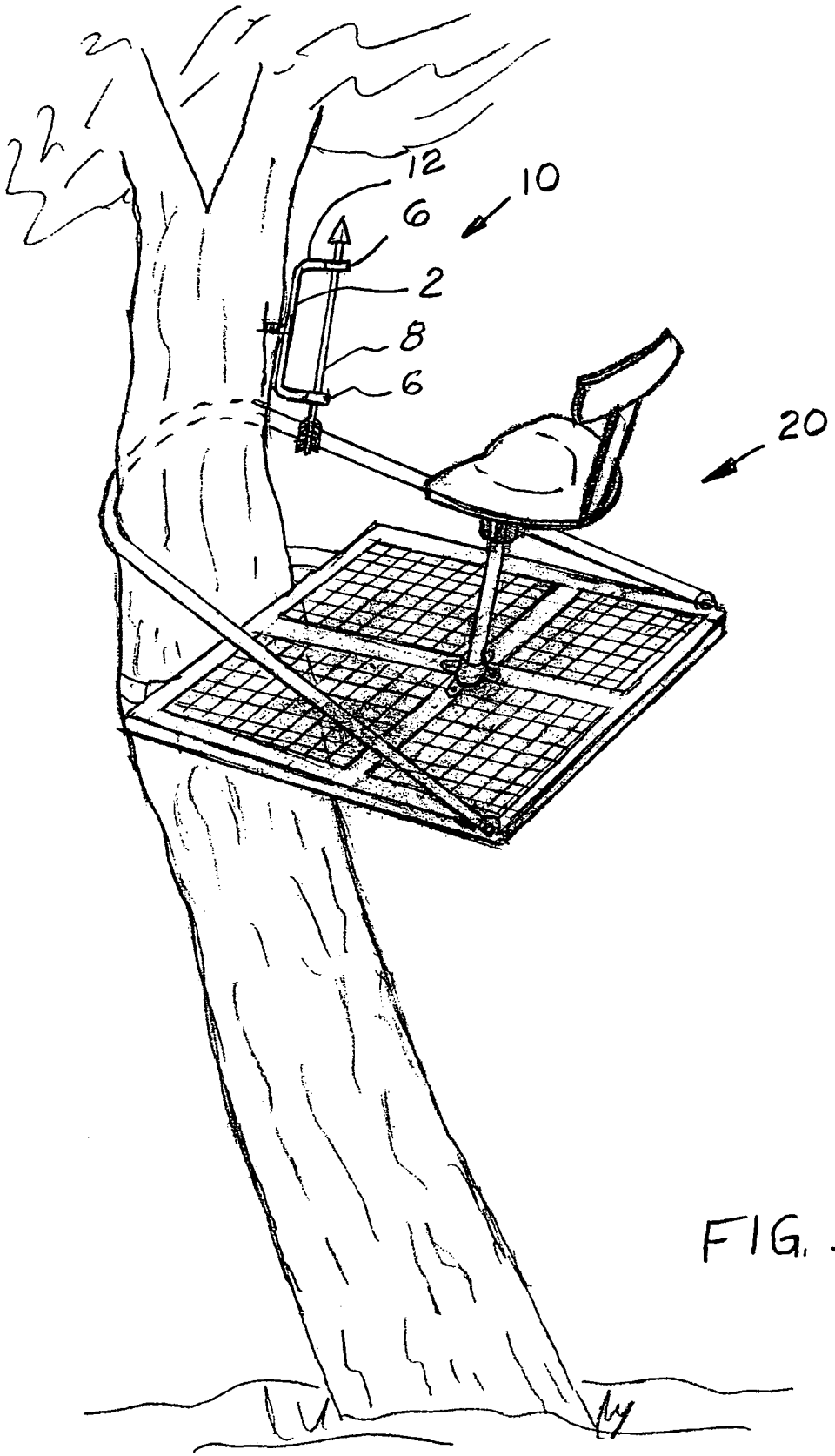
FIG. 3 is a perspective view of the present invention in combination with a tree stand.

FIG. 3 is a perspective view of the present invention in combination with a tree stand. The bow hunter sits in a tree stand 20 and is ready to shoot at his prey, generally a deer, the arrow holder 10 is screwed into the trunk of a tree and a spare arrow 8 is disposed therein. The arrow 8 is ready for the bow hunter to grab the arrow 8 and reload quickly so as to get a second shot if the first shot misses.

While a presently preferred embodiment and alternate embodiments of the present invention has been described in detail above, it should be understood that various other adaptations and/or modifications of the invention can be made by those persons who are particularly skilled in the art without departing from either the spirit of the invention or the scope of the appended claims.

I claim:

1. An apparatus for use by a bow hunter using a tree stand to hunt, said apparatus comprising:

(a) a rod member having a predetermined shape and formed of a first predetermined material, said rod member having a substantially flat base portion and an arm extending outwardly from each end, in a same direction, of said substantially flat base portion;

(b) a screw member engageable intermediate each end of said substantially flat base portion of said rod member for attaching said rod member to a tree, said screw member disposed on an opposite side of said flat base portion than said arm extending outwardly from each end; and (c) at least one holder attached to at least one end of each said arm member for holding an arrow, said at least one holder being formed of a second predetermined material.

2. The apparatus, according to claim 1, wherein said predetermined shape of said rod member is a block C-shape.

3. The apparatus, according to claim 2, wherein said block C-shaped rod member is disposed on such tree so that such arrow disposed therein is secured in a substantially vertical plane with point of such arrow up.

4. The apparatus, according to claim 2, wherein said screw member is disposed substantially at a mid point of a center portion of said base portion of said block C-shaped rod member.

5. The apparatus, according to claim 2, wherein said block C-shaped rod member is between about 1¾ inches and about 2¼ inches in length.

6. The apparatus, according to claim 1, wherein said first predetermined material is metal.

7. The apparatus, according to claim 6, wherein said metal is steel.

8. The apparatus, according to claim 6, wherein said second predetermined material is an elastomeric material.

9. The apparatus, according to claim 8, wherein said elastomeric material is selected from one of plastic, natural rubber, synthetic rubber and various combinations thereof.

10. The apparatus, according to claim 9, wherein said second predetermined material is synthetic rubber.

11. The apparatus, according to claim 1, wherein said apparatus is colored in one of a natural coloring and camouflage coloring.

12. The apparatus, according to claim 11, wherein said apparatus is colored in camouflage coloring.

13. The apparatus, according to claim 1, wherein said screw member is between about 1¾ inches and about 2¼ inches in length.

14. The apparatus, according to claim 1, wherein said apparatus from a tip of said screw member to an outer end of said holder is between about 3½ inches and about 4½ inches in length.

15. The apparatus, according to claim 14, wherein said apparatus from said tip of said screw member to said outer end of said holder is between about 3⅞ inches and about 4⅛ inches in length.

16. The apparatus, according to claim 1, wherein both arms extending outwardly from said each end of said base portion are substantially parallel.

17. In combination with a tree stand the improvement comprising an apparatus for use by a bow hunter using said tree stand, said apparatus including, (a) a rod member having a predetermined shape and formed of a first predetermined material, said rod member having a substantially flat base portion and an arm extending outwardly from each end, in a same direction, of said substantially flat base portion;

(b) a screw member engageable intermediate each end of said substantially flat base portion of said rod member for attaching said rod member to a tree, said screw member disposed on an opposite side of said flat base portion than said arm extending outwardly from each end; and (c) at least one holder attached to at least one end of each said arm member for holding an arrow, said at least one holder being formed of a second predetermined material.

* * * * *